United States Patent [19]

Eidels-Dubovoy

[11] 4,399,926

[45] Aug. 23, 1983

[54] RESEALABLE EASY-OPENING CONTAINER

[76] Inventor: Samuel Eidels-Dubovoy, Canal del Norte No. 476 Colonia 20 de Noviembre, Mexico City, Mexico, 15300

[21] Appl. No.: 373,223

[22] Filed: Apr. 29, 1982

[51] Int. Cl.[3] ..... B65D 41/04

[52] U.S. Cl. ..... 220/288; 220/94 R; 220/91; 220/284

[58] Field of Search ..... 220/284, 288, 91, 94 R, 220/DIG. 12, 16; 150/0.5

[56] References Cited

U.S. PATENT DOCUMENTS

| | | | |
|---|---|---|---|
| 3,189,072 | 6/1965 | Starr | 220/288 |
| 3,339,794 | 9/1967 | Olerlander et al. | 220/91 |
| 3,432,070 | 3/1969 | Carpenter, Jr. et al. | 220/288 |
| 4,014,452 | 3/1977 | Galer | 220/288 |

*Primary Examiner*—George T. Hall

*Attorney, Agent, or Firm*—McDougall, Hersh & Scott

[57] ABSTRACT

A resealable easy-opening container comprises an elongate body portion closed at a lower end and open at an upper end which includes a neck having an inner surface and a threaded outer surface, the container having means recessed within the body portion for the attachment of a handle, and a cover threadably connected to the neck of the container, the cover including a top panel having an upper surface and a lower surface; a cylindrical side wall depending from the lower surface of the top panel having a thread on the inside surface thereof for cooperating with the container neck threads; an annular sealing flange extending downwardly from the lower surface of the top panel for engagement with the inner surface of the neck; and gripping means comprising an elongate slot in the upper surface of the top panel and a plurality of vertical ribs about the cylindrical side wall.

7 Claims, 3 Drawing Figures

RESEALABLE EASY-OPENING CONTAINER

BACKGROUND OF THE INVENTION

The present invention relates to a resealable container formed of a thermoplastic resin including high density polyethylene and polypropylene having an enlarged opening at the upper end thereof. The container is particularly well-suited for holding paints and materials of similar consistency which must be stored under airtight conditions, but which require an enlarged upper opening for convenient access.

Conventional containers having enlarged openings are difficult to open because a normal-sized hand cannot adequately grasp the cover or lid and provide the necessary torque to rotate the cover.

It follows that it is an object of the present invention to provide a resealable container that can be opened easily to store materials under airtight conditions. The relatively wide cover can be rotated easily without regard to the hand-size of the operator.

A further object of this invention is to provide a resealable container having an enlarged opening at the upper end thereof for convenient access.

An additional object of this invention is to provide a resealable container designed for maximum strength and compact storage.

Other objects and advantages of the invention will be apparent from the remaining portion of the specification.

SUMMARY OF THE INVENTION

A resealable easy-opening container comprises an elongate body portion closed at a lower end and open at an upper end which includes a neck having an inner surface and a threaded outer surface, the container having means recessed within the body portion for the attachment of a handle, and a cover threadably connected to the neck of the container. The cover includes a top panel having an upper surface and a lower surface, a cylindrical side wall depending from the lower surface of the top panel having a thread on the inside surface thereof for cooperating with the container neck threads, an annular sealing flange extending downwardly from the lower surface of the top panel for engagement with the inner surface of the neck, and gripping means comprising (1) an elongate slot in the upper surface on the top panel and (2) a plurality of vertical ribs about the cylindrical side wall.

The container can be opened mechanically or manually. To open the container mechanically, the rigid edge of a paint brush or a similar object is placed within the elongate slot of the cover and the body portion of the container is held with one hand while the other hand rotates the brush handle and the cover is a counterclockwise direction.

The cover can be removed manually by placing four fingers of one hand within the elongate slot, pressing the thumb of that hand against the vertical ribs on the cylindrical side wall and rotating the cover while the other hand holds the body portion of the container in a stationary position.

DETAILED DESCRIPTION OF THE INVENTION

Figure 1:
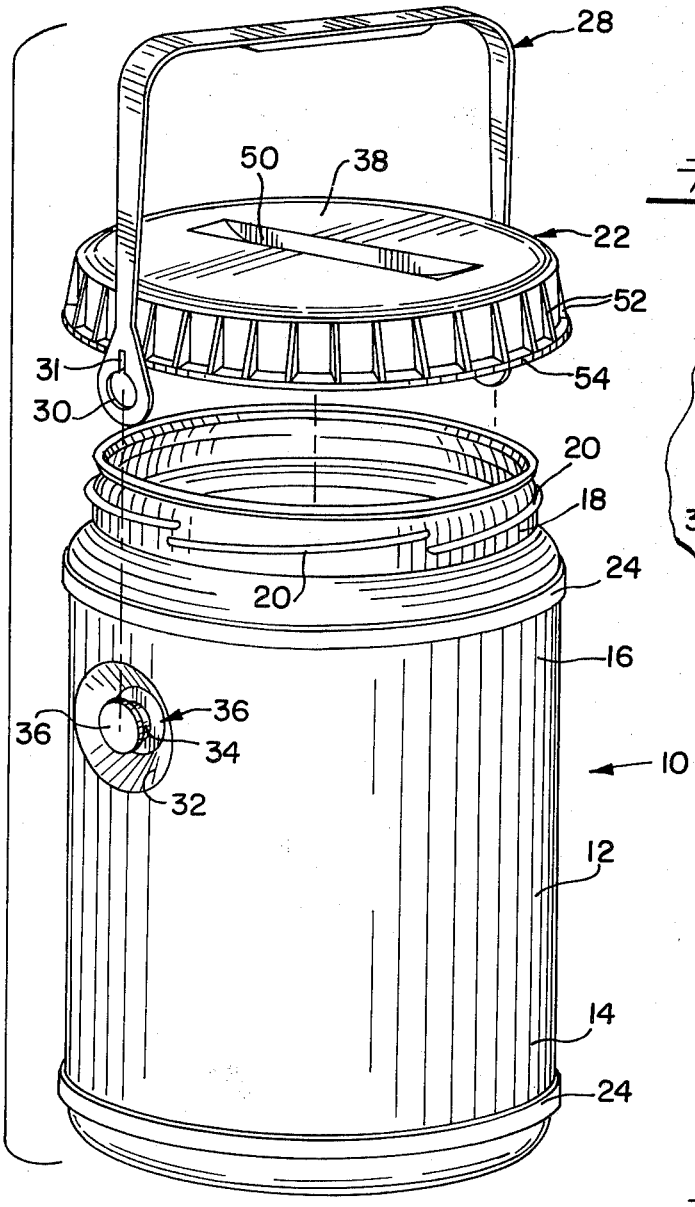
FIG. 1 is an exploded perspective view of the container.

Referring to FIG. 1, the container generally indicated by the reference numeral 10 is shown in an exploded perspective view. The container 10 includes an elongate body portion 12 that is closed at a lower end 14 and open at an upper end 16. The upper end 16 of the body portion 12 is somewhat narrowed to form a neck 18 which includes threads 20 on the outer surface thereof for receiving a cover 22. The threads 20 can be positioned about the neck 18 so that the cover 22 detaches from the container after rotation in a counterclockwise direction.

The body portion 12 has at least one annular member 24 about the lower end 14 and the upper end 16 which increase the rigidity of the container. The annular members 24 are particularly important when the container is formed of a thermoplastic such as high density polyethylene or polypropylene to increase the rigidity of the body portion.

Moreover, when the containers are stacked, the annular members 24 prevent the body portions of adjacent containers from contacting so that product labels or the like affixed to the body portions are not torn or otherwise damaged.

The upper end 16 of the body portion 12 also includes recessed means 26 on opposed sides for attaching a flexible handle 28 having a circular opening 30 cooperating with a slot 31 at each end thereof. Specifically, the recessed means comprises a cavity 32 and a knob or extension 34. At the end of the knob 34 is a disk member 36 which is enlarged relative to the diameter of the knob and which does not extend beyond the circumferential surface of the body portion 12.

The cover 22 comprises a top panel 38 having an upper surface 40 and a lower surface 42; a cylindrical side wall 44 depending from the lower surface 42 of the top panel having a thread 46 on the inside surface thereof which cooperates with the threads 20 about the outer surface of the neck 18; an annular sealing flange 48 (see FIG. 2) that extends downwardly from the lower surface 42 of the top panel 38 for engagement with the inner surface of the neck 18; and gripping means comprising (1) an elongate slot 50 in the upper surface 40 of the top panel 38 and (2) a plurality of vertical ribs 52 about the cylindrical side wall 44. The lower end of the cylindrical side wall 44 can include an outwardly extending flange 54—the lower ends of the vertical ribs 52 abut the flange 54.

Figure 2:
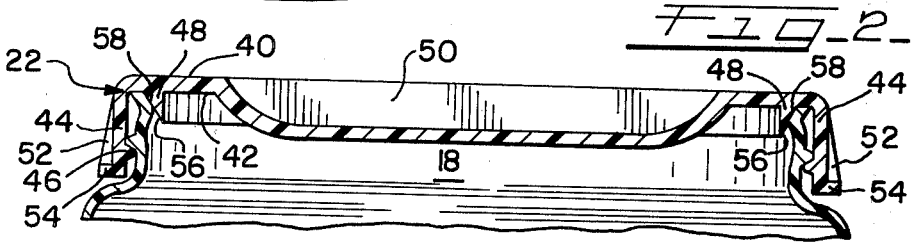
FIG. 2 is a cross-sectional view of the cover secured to the container neck.

With particular reference to FIG. 2, the annular sealing flange 48 has a generally triangular cross-sectional shape. The flange 48 includes a first sloped surface 56 that sealingly engages a corresponding second sloped surface 58, formed about the inner surface at the upper end of the neck 18 as the cover 22 is tightened about the neck 18. When the first sloped surface 56 of the flange 48 engages the second sloped surface 58 of the neck 18, the lower surface 42 of the top panel 38 presses against the upper edge of the neck 18 to seal the container airtight.

Figure 3:
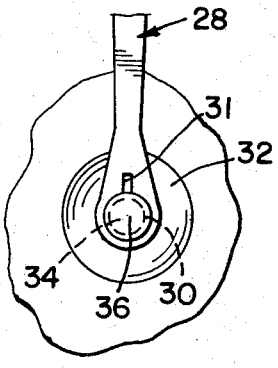
FIG. 3 is a partial side view showing the attachment of the handle to the container.

Referring to FIG. 3, the attachment of the handle 28 to the recessed means 26 within the upper end 16 of the body portion 12 is shown. The hole 30 at each end of the handle 28 is forced over the disk member 36 on either side of the body portion 12. Each end of the handle is then removably secured about the knob 34 so the container can be supported by the handle 28, and yet the container can be compactly stored when the handle is removed.

The container can be opened or closed mechanically or manually. For example, if the container is used to hold paint, a paint brush can be used as a tool to remove or to replace the cover so that additional tools are unncessary, unlike conventional paint cans, to pry the cover free.

Specifically, to open the container mechanically, the rigid edge of a paint brush or a similar object is placed within the elongate slot 50 of the cover 22 and the body portion 12 of the container is held with one hand while the other hand rotates the brush handle and the cover in a counterclockwise direction.

The cover 22 can also be removed manually by placing four fingers of one hand within the elongate slot 50, pressing the thumb of that hand against the vertical ribs 52 on the cylindrical side wall 44 and rotating the cover while the other hand holds the body portion 12 of the container in a stationary position.

The present invention comprises a safe, efficient way to store materials under airtight conditions for convenient access. In addition to being resealable, the container is reuseable.

It will be understood that various changes and modifications can be made in the above-described invention without departing from the spirit thereof, particularly as defined in the following claims.

That which is claimed is:

1. A resealable, easy-opening container comprising:

(a) an elongate body portion closed at a lower end and open at an upper end which includes a neck; and (b) a cover adapted to removably engage the neck of the body portion, said cover including:

(i) a top panel;

(ii) a cylindrical side wall depending from the top panel having means for securing said cover to said neck;

(iii) an annular sealing flange also depending from the top panel but spaced radially inwardly from the side wall, extending downwardly from the top panel to bear against the inner surface of the neck to form a seal to prevent the passage of fluids into or out of the container; and (iv) gripping means comprising an elongate slot formed in the top panel and a plurality of vertical ribs about the cylindrical side wall.

2. The container according to claim 1 wherein the annular sealing flange has a generally triangular cross-sectional shape and includes a sloped surface that sealingly engages the inner surface of the neck.

3. The container according to claim 1 wherein the annular sealing flange has a generally triangular cross-sectional shape and includes a sloped surface, and the inner surface of the neck at the upper end thereof also includes a parallel sloped surface whereby when the cover is tightened onto the neck, said sloped surfaces engage to seal the container.

4. The container according to claim 1 including recessed means within the body portion at the upper end thereof for attachment of a handle, said recessed means comprising a cavity in opposed sides of said body portion, said cavity including projecting means which does not extend beyond the circumferential surface of the body portion.

5. The container according to claim 4 wherein said projecting means includes an extension having a member at one end thereof which is enlarged relative to the cross-sectional area of the extension, said projecting means being adapted to removably engage a handle having an opening in each end thereof whereby the handle can be secured to the projecting means for transport of the container and the container can be compactly stored when the handle is removed.

6. The container according to claim 4 wherein said projecting means includes a cylindrical extension having a disk member at one end thereof which is enlarged relative to the diameter of the cylindrical extension, said projecting means being adapted to removably engage a handle having an opening in each end thereof whereby the handle can be secured to the projecting means for transport of the container and the container can be compactly stored when the handle is removed.

7. The container according to claim 1 including a plurality of annular members about the upper and lower ends of the body portion which increase the rigidity of the container and which prevent the body portions of adjacent containers from contacting so that labels affixed to the body portions are not damaged.

* * * * *